United States Patent [19]

Foley et al.

[11] Patent Number: 4,603,247

[45] Date of Patent: Jul. 29, 1986

[54] ELECTRICAL DUCT HEATER ASSEMBLY

[75] Inventors: James C. Foley, Arnold; Roy W. Morrison, Jr., Maplewood, both of Mo.

[73] Assignee: Industrial Engineering and Equipment Company, Incorporated, St. Louis, Mo.

[21] Appl. No.: 643,081

[22] Filed: Aug. 13, 1984

Related U.S. Application Data

[63] Continuation of Ser. No. 407,505, Aug. 12, 1982, abandoned.

[51] Int. Cl.[4] ..... H05B 3/02; F24H 3/04

[52] U.S. Cl. ..... 219/374; 138/103; 219/366; 219/375; 219/532

[58] Field of Search ..... 219/374, 375, 376, 381, 219/366, 532; 138/107, 103, 106

[56] References Cited

U.S. PATENT DOCUMENTS

| | | | |
|---|---|---|---|
| 2,712,588 | 7/1955 | Epstein | 219/374 |
| 2,956,587 | 10/1960 | Fisher | 138/107 |
| 3,029,332 | 4/1962 | Cotts | 219/374 |
| 3,102,185 | 8/1963 | Boyd et al. | 219/374 |
| 3,440,400 | 4/1969 | Cotts | 219/374 |
| 3,631,525 | 12/1971 | Brasch | 219/374 |
| 3,794,810 | 2/1974 | Brasch et al. | 219/374 |
| 3,851,147 | 11/1974 | Hachmeister | 219/381 |
| 4,131,787 | 12/1978 | Tyler | 219/532 |

OTHER PUBLICATIONS

"Electric Blast Coil Duct Heaters", by Indeeco, 06/10/1963, p. 30.

*Primary Examiner*—Clarence L. Albritton
*Assistant Examiner*—Geoffrey S. Evans
*Attorney, Agent, or Firm*—Cohn, Powell & Hind

[57] ABSTRACT

This duct heater assembly includes a duct section having upper and lower wall portions and opposed side portions. The upper and lower portions include end margin portions connectible to the end margins of conventional duct line section by "S" strip connectors. The side portions include C-shaped flanges connectible to the C-shaped flanges of conventional duct line sections by "C" strip connectors. One of the side portions incorporates a control box having an overhanging end spaced from the side wall of an adjacent conventional duct line section to accommodate the "C" strip connectors.

7 Claims, 9 Drawing Figures

ELECTRICAL DUCT HEATER ASSEMBLY

This is a continuation of application Ser. No. 06/407,505, filed Aug. 12, 1982, now abandoned.

BACKGROUND OF THE INVENTION

This invention relates generally to duct heaters and particularly to a duct heater which is adapted to fit into a conventional rectangular heater duct line.

Duct heaters which include a set of heating elements and a control box are generally of two types. In one type the duct heater is provided with outstanding flanges which extend perpendicularly to the axis of the duct line. In order to emplace this unit in a duct line, the otherwise conventional connecting ducts must be modified to provide comparable outstanding flanges which are then connected by fasteners to the duct heater. The other type of duct heater is referred to generally as a "slip-in" heater and requires that the otherwise conventional duct line be provided with a side opening to receive the slip-in unit.

As will be readily understood both of the above type of heater require radical modification of the duct line.

The present duct heater overcomes the above and other disadvantages in a manner not disclosed in the known prior art.

SUMMARY OF THE INVENTION

This duct heater is intended for use with conventional duct line sections and can be connected between two conventional duct line sections without requiring that the sections be provided with special attachment means or openings.

This duct heater assembly is connected between the ends of longitudinally adjacent rectangular duct line sections of the type including opposed upper and lower portions having transverse "S" slip connection means at each end and opposed side portions having transverse "C" slip connection means at each end.

The duct heater assembly comprises a rectangular duct heater section longitudinally aligned with the duct line sections and including an upper portion having opposed ends, a lower portion having opposed ends substantially coterminus with said upper portion ends, a first side portion interconnecting said upper and lower portions and having opposed ends, a second side portion interconnecting said upper and lower portions and having opposed ends, and at least one of said side portions including a control box having an overhanging end portion disposed, at least in part, in spaced side-by-side relation to the longitudinally adjacent duct line section.

The duct heater assembly also includes connection means connecting the duct heater section to the duct line sections said connecting means including "S" slip connection means transversely disposed at each end of the duct heater connection upper and lower portions and attached to said upper and lower portions and being connectible to the "S" slip connection means of the upper and lower portions of the longitudinally adjacent duct line sections; and said connection means also including "C" slip connection means extending transversely between and being generally aligned with the "S" slip connection means at each end of the duct heater upper and lower portions, said "C" slip connection means being attached to associated side portions of the duct heater assembly, and being connectible to the "C" slip connection means of the side portions of longitudinally adjacent duct line sections and the "C" slip connection means adjacent the overhanging end portion of the control box being disposed within the space between the control box and the adjacent duct line section.

In one aspect of the invention the duct heater first side portion includes the control box having the overhanging end portion, and the second side portion is substantially co-terminus with the upper and lower portions.

In another aspect of the invention, the other end of the first side portion is substantially co-terminus with the upper and lower portions.

In yet another aspect of the invention the control box includes a rear panel, an end panel disposed at the remote end of the overhanging end portion, and another end panel disposed at the end opposite the overhanging end portion and the "C" slip connection means at the end adjacent the overhanging end portion is attached to said rear panel.

In another aspect of the invention the "C" slip connection means at the other, end of the first side portion is attached to said other end panel of the control box.

In still another aspect of the invention the upper and lower portions each include recessed panels having outstanding margin portions and the "S" slip connection means are integrally formed with said outstanding margin portions.

In still another aspect of the invention the second side portion includes a recessed panel having outstanding margin portions and the "C" slip connection means are integrally formed with said outstanding margin portions.

In yet another aspect of the invention the "C" slip connection means at the end adjacent the overhanging end portion of the control box include a C-shaped flange and an integrally formed re-entrant leg fixedly attached to the control box rear panel. In another aspect of the invention the "C" slip connection means at the other end of the first side portion includes a C-shaped flange and an integrally formed leg which is rigidly attached to said control box other end panel.

In another aspect of the invention the upper and lower portions on the duct heater section on the control box side thereof, extend outwardly beyond the duct line section side portions and the control box is connected between said outwardly extending upper and lower portions.

DESCRIPTION OF THE PREFERRED EMBODIMENT

Figures 1, 2, 3:
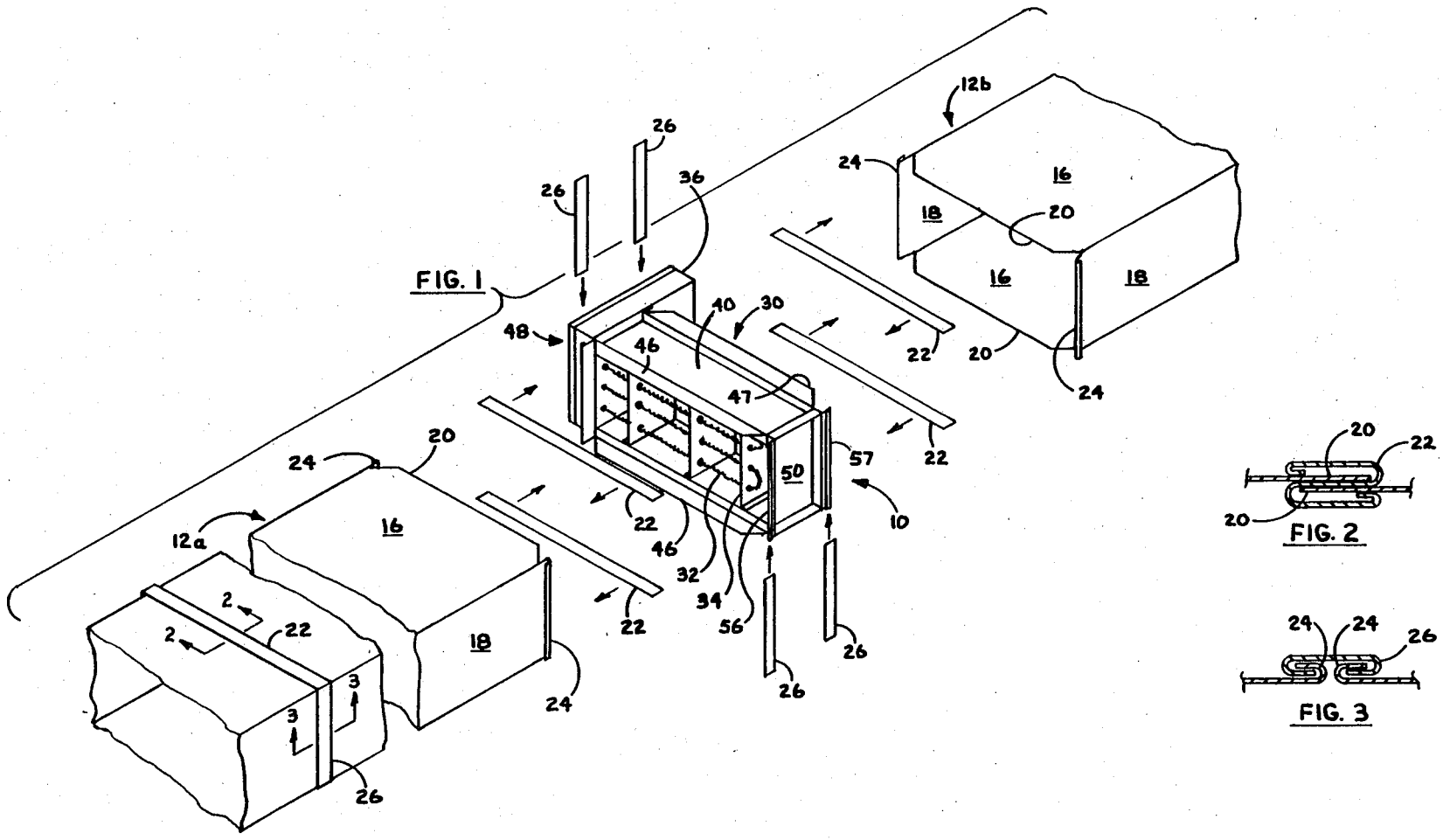
FIG. 1 is a perspective view of the duct heater assembly used in conjunction with a conventional duct line.
FIG. 2 is an enlarged cross-sectional view taken on line 2—2 of FIG. 1.
FIG. 3 is an enlarged cross-sectional view taken on line 3—3 of FIG. 1.
Figure 5:
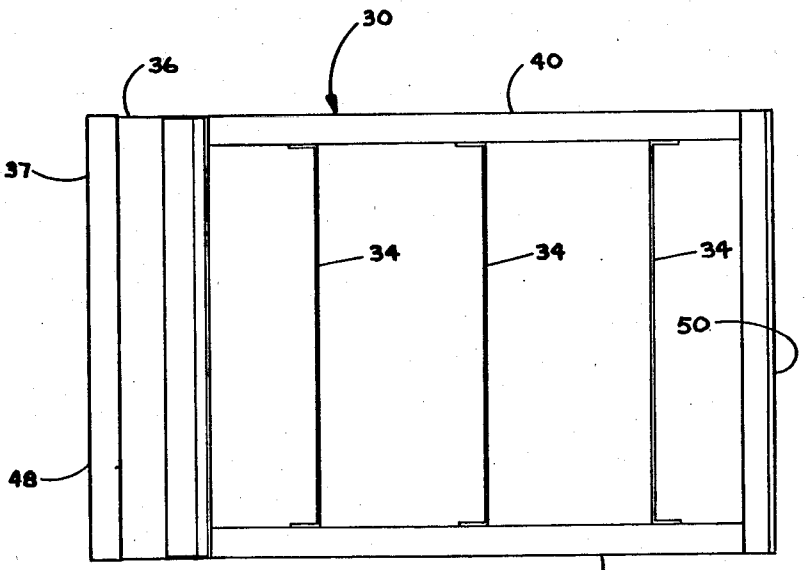
FIG. 5 is an end view taken on line 5—5 of FIG. 4 with the slip connectors omitted.

Referring now by reference numerals to the drawings and first to FIG. 1 it will be understood that the duct heater assembly, generally indicated by numeral 10, is intended to be inserted within opposed sections 12*a* and 12*b*, of a conventional duct line, with which it is longitudinally aligned. Such duct line sections are generally rectangular in configuration and include opposed upper and lower wall portions 16 and opposed side wall portions 18 interconnecting said upper and lower portions.

The ends of the upper and lower portions 16 of each of the duct line sections 12*a* and 12*b* include end margin portions 20 which, when two conventional duct sections are to be connected, provide connection means disposed in overlapping relation, as shown in FIG. 2, for interconnection by conventional hemmed "S" slips 22. The ends of the side portions 18 of the duct line sections 12 include C-shaped margin portions 24 at each end which, when two conventional duct sections are to be connected, provide connection means disposed in abutting relation, as shown in FIG. 3, for connection by conventional "C" slips 26.

The duct heater assembly 10, which is inserted between conventional duct line sections 12*a* and 12*b*, includes a duct section 30 which, in the preferred embodiment, houses a conventional electric heater unit 32 mounted between intermediate panels 34, and a control box section 36 which, in the embodiment shown, provides one side of the duct section 30. The controls themselves form no part of this invention and are omitted for clarity.

Figure 8:
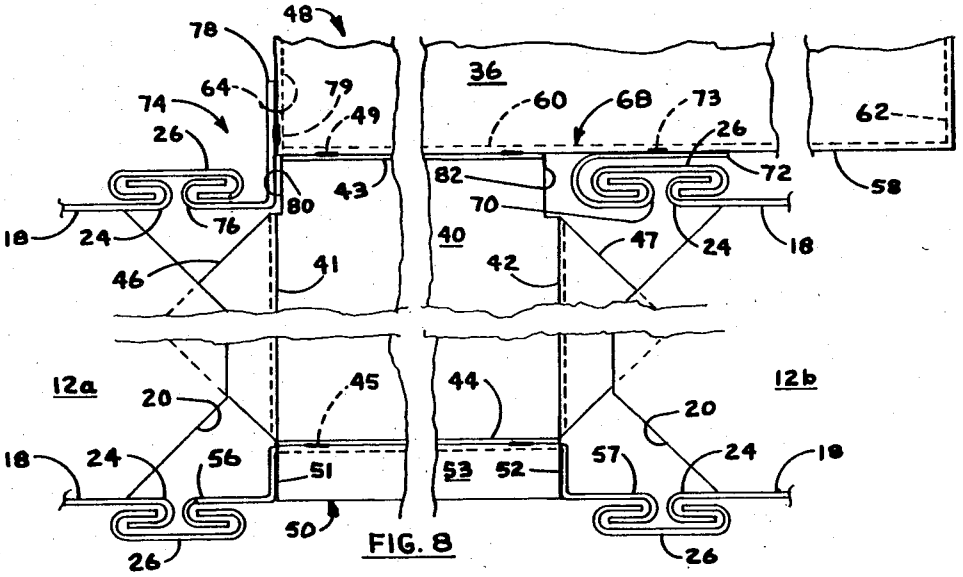
FIG. 8 is an enlarged fragmentary plan view.
Figure 9:
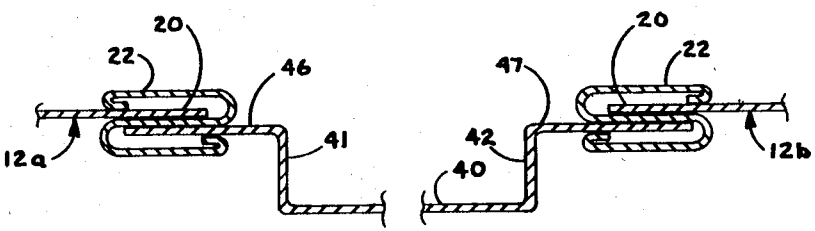
FIG. 9 is an enlarged fragmentary cross-sectional view taken on line 9—9 of FIG. 4.
Figure 6:
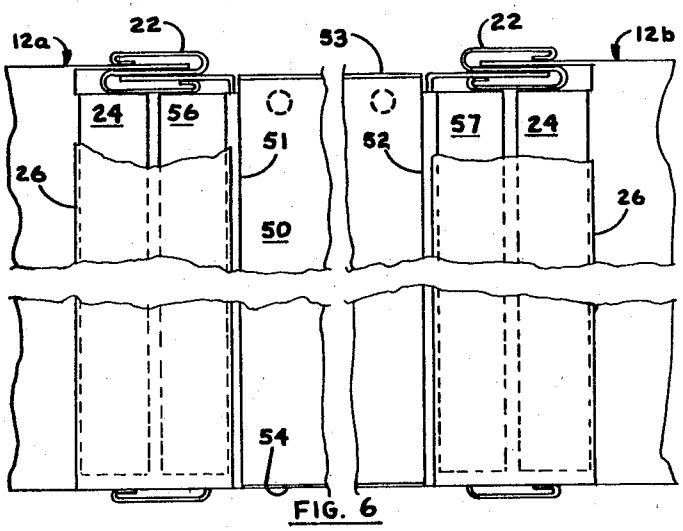
FIG. 6 is an enlarged fragmentary elevational view taken on line 6—6 of FIG. 4 at one side of the duct heater.

More particularly, the duct heater assembly 10 is generally rectangular and includes upper and lower recessed panel portions 40. As shown in FIG. 8 each panel portion 40 includes opposed, outstanding end margin portions 41 and 42 and side margin portions 43 and 44, the end margin portions 41 and 42 having integrally formed, longitudinally extending flanges 46 and 47 respectively. The flanges 46 and 47 constitute transversely disposed "S" slip connection means, which are connectible to the "S" slip connection means provided by the margin portions 20 of the longitudinally adjacent duct line sections 12*a* and 12*b*, respectively, by means of elongate "S" slip connectors 22.

The heater assembly 10 also includes first and second side portions 48 and 50. The first side portion 48, in the embodiment shown, incorporates the control box 36 as will be discussed later. The second side portion 50 is similar to the upper and lower portions 40 in that it comprises essentially a recessed panel having opposed outstanding end margin portions 51 and 52 and side margin portions 53 and 54. End margin portions 51 and 52 are provided with integrally formed C-shaped flanges 56 and 57 respectively, which constitute "C" slip connection means. Flanges 56 and 57 extend between and are generally aligned with the "S" slip connection means provided by flanges 46 and 47 at each end of the heater duct upper and lower portions and are connectible to the "C" slip connection means provided by the margin portions 24 of the duct line sections 12*a* and 12*b* respectively by means of "C" slip connectors 26, which have the same center line as the corresponding perpendicularly related "S" connectors 22. In the embodiment shown the side portion 50 is rigidly connected between the upper and lower longitudinal margin portions 44 of the upper and lower panels 40, as by spot welding 45.

Figure 4:
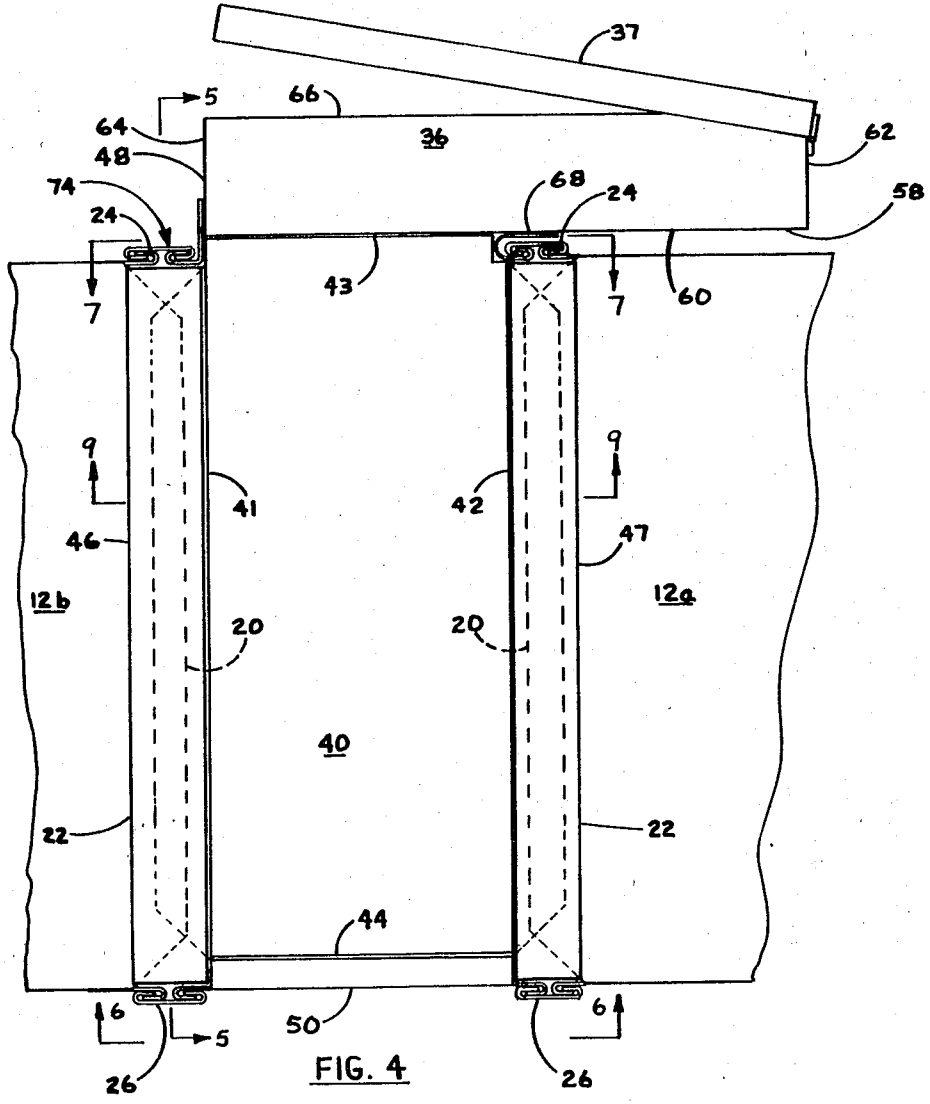
FIG. 4 is a simplified plan view of the duct heater assembly showing the slip connectors in place.

The first side portion 48 incorporates the control box 36 which includes a hinged cover 37. As shown in FIGS. 4 and 8 the control box 36 includes an overhanging end portion 58, and is defined by a rear panel 60, an end panel 62 provided at the remote end of the overhanging end portion, and end panel 64 provided at the other end of said rear panel 60. Also provided are opposed upper and lower panels 66. As clearly shown in FIG. 4, the overhanging end portion is disposed in spaced side-by-side relation to the longitudinally adjacent duct line section 12*b*. The rear panel 60 is rigidly connected to the outstanding side margin portions 43 of the upper and lower recessed panel portions 40, as by spot welding at 49, as shown in FIG. 8.

Figure 7:
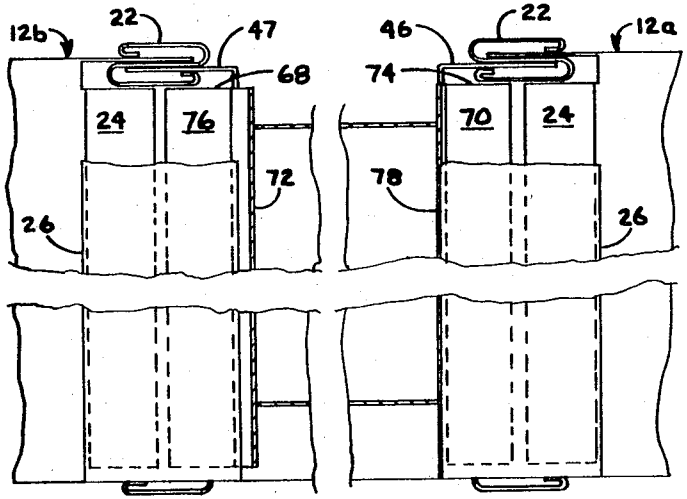
FIG. 7 is an enlarged fragmentary longitudinal sectional view taken on line 7—7 of FIG. 4 at the other side of the duct heater.

As shown in FIGS. 4, 7 and 8 the control box side portion 48 is provided with longitudinally spaced "C" slip connection means, extending transversely between and generally aligned with the "S" slip connection means at each end of the duct heater upper and lower portions. The "C" slip connection means adjacent the overhanging end portion 58 is provided by an elongate member 68 which includes a C-shaped flange 70, and an integrally formed re-entrant leg 72, said leg being rigidly attached to the control box rear panel 60 as by intermittent spot welding 73. The C-shaped flange 70 is disposed oppositely of and in register with the C-shaped flange 57 of the second side portion 50, and like said flange 57, is connectible to a "C" slip connection means provided by the margin portion 24 of the longitudinally adjacent duct line section 12*b* by means of a "C" slip connector 26. The "C" slip connection means at the other end of the control box 36 is provided by an elongate member 74 which includes a C-shaped flange 76 and an integrally formed leg 78, said leg being rigidly attached to the control box side panel 64 as by intermittent spot welding at 79. The C-shaped flange 76 is disposed oppositely of and in register with the C-shaped flange 56 of the second side portion 50 and, like said flange 50, is connectible to a "C" slip connection means provided by the margin portion 24 of the longitudinally adjacent duct line section 12*a* by means of a "C" slip connector 26. As shown in FIG. 8, the end flanges 41 and 42 of the upper and lower panels 40 are cut away at 80 and 82, to facilitate formation and attachment of the elongate members 74 and 68, respectively.

It is thought that the functional advantages and structural features of this duct heater 10 have become fully apparent from the foregoing description of parts, but for completeness of disclosure, the installation of the duct heater will be briefly described.

The duct heater 10 includes "S" slip connection means at each end of the upper and lower panel portions 40 provided by flanges 41 and 42 which are effectively aligned with and are virtually identical to the conventional duct section "S" slip connection means provided by the end margin portions 20 of the adjacent duct line sections 12*a* and 12*b*.

The duct heater 10 also includes "C" slip connection means at each end of the first and second side portions 48 and 50. In the case of the first side portion 48, the "C" slip connection means are provided by C-shaped flange 76 attached to the control box end panel 50, and C-shaped flange 70, attached to the control box rear panel 60. In the case of the second side portion 50, the heater duct "C" slip connection means at each end of the second side portion 52 provided by C-shaped flanges 56 and 57. At both sides the C-shaped flanges are effectively aligned with and are virtually identical to the conventional duct section "C" slip connection means provided by the C-shaped margin portions 24 at each end of the adjacent duct line sections 12*a* and 12*b*.

Because of this structural arrangement of parts, it is possible to connect the duct heater section 30 to adjacent duct line sections 12*a* and 12*b*, exactly in the same manner as if sections 12*a* and 12*b* were connected to each other, by means of conventional "S" slip connectors 22 and "C" slip connectors 26. This type of connection is possible because of the fact that the control box rear panel 60 is offset in spaced relation from the aligned side portions 18 of the duct line sections 12*a* and 12*b*. In effect, means are provided to attach the control box 36 to the duct heater section 30 in such a manner that said control box is clear of the plane of said aligned conventional duct section side portions. In the preferred embodiment the attachment means are provided by extending the duct heater upper and lower portions outwardly of the plane of the aligned conventional duct side portions 18. This attachment means permits the control box rear panel 60 to be clear of the first side portion C-shaped flanges 70 and 76, and the control box structure does not interfere with the connection of the duct heater to the duct line sections. The recessed upper and lower panels 40, and the second side panel 50, together with the control box 36 which also, in offect, provides a recessed panel, cooperate to provide a reinforced duct heater assembly.

We claim as our invention:

1. In a duct line a pair of rectangular duct line sections including opposed upper and lower portions having transverse "S" slip connection means at each end and opposed side portions having transverse "C" slip connection means at each end, a rectangular duct heater section disposed between and in generally longitudinally aligned relation with the duct line sections including:

1. an upper portion having opposed ends,
2. a lower portion having opposed ends substantially co-terminus with said upper portion ends,
3. a first side portion interconnecting said upper and lower portions and having opposed ends,
4. a second side portion interconnecting said upper and lower portions and having opposed ends, and
5. at least one of said side portions including a control box having an overhanging end portion disposed at least in part in spaced side-by-side realtion to the longitudinally adjacent duct line section, and means operatively connecting the duct heater section to the duct line sections including:

1. "S" slip connection means transversely disposed at each end of the duct heater connection upper and lower portions, said connection means being attached to said associated upper and lower portions and being connectible to the "S" slip connection means of the upper and lower portions of longitudinally adjacent duct line section,
2. "C" slip connection means extending transversely between and being generally aligned with the "S" slip connection means at each end of the duct heater upper and lower portions, said "C" slip connection means being attached to associated side portions and being connectible to the "C" slip connection means of the side portions of longitudinally adjacent duct line sections, and
3. the "C" slip connection means adjacent the overhanging end portion of the control box being disposed within the space between said control box and said adjacent duct line section, said "C" slip connection means being fixedly attached to said control box and said control box overhanging end extending beyond said "C" slip connection means.

2. A duct line as defined in claim 1, in which:

the first side portion includes the control box having the overhanging end portion, and the control box includes a rear panel, an end panel disposed at the remote end of the overhanging end portion, and another end panel disposed at the end opposite the overhanging end portion, and the "C" slip connection means at the end adjacent the overhanging end portion is attahced to said rear panel.

3. A duct line as defined in claim 2, in which:

the "C" slip connection means at the other end of the first side portion is attached to said other end panel of the control box.

4. A duct line as defined in claim 2, in which:

said "C" slip connection means at the end adjacent the overhanging end portion of the control box includes a C-shaped flange and an integrally formed re-entrant leg fixedly attached to the control box rear panel.

5. A duct line as defined in claim 2, in which:

said "C" slip connection means at the other end of the first side portion includes a "C" shaped flange and an integrally formed leg which is rigidly attached to said control box other end panel.

6. A duct line as defined in claim 1, in which:

the upper and lower portions of the duct heater section on the control box side thereof extend transversely outwardly beyond the duct line section side portions, and the control box is connected between the outwardly extending upper and lower portions.

7. A duct heater assembly for connection between the ends of a pair of rectangular duct line sections including opposed upper and lower portions having transverse "S" slip connection means at each end, and opposed side portions having transverse "C" slip connection means at each end, and a rectangular duct heater section disposed between and in generally longitudinally aligned relation with the duct line sections including:

1. an upper portion having opposed ends,
2. a lower portion having opposed ends substantially co-terminus with said upper portion ends,
3. a first side portion interconnecting said upper and lower portions and having opposed ends,
4. a second side portion interconnecting said upper and lower portions and having opposed ends, and
5. at least one of said side portions including a control box having an overhanging end portion, said control box having a rear panel disposed in spaced side-by-side relation to the longitudinally extending duct line and opposed end panels disposed at the remote end of the overhanging portion and the end opposite the overhanging end portion respectively, means operatively connecting the duct heater section to the duct line sections including:

1. "S" slip connection means transversely disposed at eacn end of the duct heater connection upper and lower portions, said connection means being attached to said associated upper and lower portions and being connectible to the "S" slip connection means of the upper and lower portions of longitudinally adjacent duct line section, 2. "C" slip connection means extending transversely between and being generally aligned with the "S" slip connection means at each end of the duct heater upper and lower portions, said "C" slip connection means being attached to associated side portions and being connectible to the "C" slip connection means of the side portions of longitudinally adjacent duct line sections, and 3. the "C" slip connection means at each end of the control box side portion being attached to the control box rear panel and said opposite end panel respectively and said rear panel extending beyond the attached "C" slip connection means, and said upper and lower portions of the duct heater section on the control box side extend transversely outwardly beyond the duct line section and are connected to said control box.

* * * * *